US009802304B2

(12) United States Patent
West et al.

(10) Patent No.: US 9,802,304 B2
(45) Date of Patent: Oct. 31, 2017

(54) ALUMINUM STRIKING TOOLS

(71) Applicant: Estwing Manufacturing Company, Inc., Rockford, IL (US)

(72) Inventors: Joshua D. West, Rockford, IL (US); Steven L. Flosi, Machesney Park, IL (US); John W. Ryan, Jr., Belvidere, IL (US)

(73) Assignee: Estwing Manufacturing Company, Inc., Rockford, IL (US)

( * ) Notice: Subject to any disclaimer, the term of this patent is extended or adjusted under 35 U.S.C. 154(b) by 0 days.

(21) Appl. No.: 14/587,503

(22) Filed: Dec. 31, 2014

(65) Prior Publication Data

US 2015/0251303 A1 Sep. 10, 2015

Related U.S. Application Data

(60) Provisional application No. 61/949,834, filed on Mar. 7, 2014.

(51) Int. Cl.
*B25D 1/02* (2006.01)
*B25D 1/12* (2006.01)
(Continued)

(52) U.S. Cl.
CPC ..... *B25D 1/02* (2013.01); *B25D 1/04* (2013.01); *B25D 1/12* (2013.01); *B25D 1/14* (2013.01);
(Continued)

(58) Field of Classification Search
CPC ... B25D 1/12; B25D 1/02; B25D 1/08; B25D 1/14; B25D 1/00; B25D 1/04; B25D 2222/00; B25D 2222/06; B25D 2222/18; B25D 2222/21; B25D 2222/24; B25D 2222/42; B25D 2222/54; B25D 2222/57; B25D 2222/69; B25D 2222/75; B25D 2250/102; B25D 2250/111; B25D 2250/241; B25D 2250/245; B25D 2250/361; B25D 1/006; B25D 2250/391; B25F 1/006
(Continued)

(56) References Cited

U.S. PATENT DOCUMENTS 121,682 A 12/1871 Stocum
270,883 A 1/1883 Bailey
(Continued)

FOREIGN PATENT DOCUMENTS

CN 202922543 U 5/2013
DE 8625497 U1 11/1986
(Continued)

OTHER PUBLICATIONS

International Search Report and Written Opinion issued in PCT application No. PCT/US2014/072969, dated Apr. 28, 2015, 11 pages.
(Continued)

*Primary Examiner* — Hadi Shakeri
(74) *Attorney, Agent, or Firm* — Quarles & Brady LLP

(57) ABSTRACT

Striking tools are disclosed that include an aluminum head. Striking surfaces may be securely attached to the head by a bushing or other means. In this way, light weight striking tools may be made with greater durability.

20 Claims, 17 Drawing Sheets

(51) Int. Cl.
*B25F 1/00* (2006.01)
*B25D 1/04* (2006.01)
*B25D 1/14* (2006.01)

(52) U.S. Cl.
CPC ..... *B25F 1/006* (2013.01); *B25D 2222/24* (2013.01); *B25D 2250/391* (2013.01)

(58) Field of Classification Search
USPC ..... 81/20, 22, 25, 26
See application file for complete search history.

(56) References Cited

U.S. PATENT DOCUMENTS 967,703 A 8/1910 Bagnall
1,045,145 A 11/1912 Hubbard
1,056,920 A * 3/1913 Lovering ..... B26B 23/00 30/308.3
1,262,515 A 9/1917 Kinglsey
1,424,161 A 8/1922 Foley
1,428,838 A 9/1922 Davis
1,523,781 A 1/1925 Keyes
1,718,161 A 6/1929 Lutch
2,067,751 A 1/1937 Beegle
2,501,440 A 3/1950 Dix
2,765,827 A 9/1953 Hall
2,671,483 A 3/1954 Clark
2,761,478 A * 9/1956 Guida ..... B25D 1/02 81/19
2,874,738 A 2/1959 Lay
2,952,284 A 9/1960 Nichols et al.
2,960,133 A 11/1960 Shepherd, Jr.
3,000,414 A 9/1961 Cordis
3,067,790 A 12/1962 Tucker
3,088,506 A 5/1963 Bianchini
3,130,762 A 4/1964 Kerr
3,148,716 A * 9/1964 Vaughan, Jr. ..... B25D 1/02 81/20
3,229,738 A 1/1966 Bianchini
3,303,863 A 2/1967 Titchnell
3,322,172 A 5/1967 Small
3,456,330 A 7/1969 Norcross
3,605,832 A 9/1971 Stephens
3,620,159 A 11/1971 Gould
3,640,324 A 2/1972 Porter
3,721,282 A 3/1973 Hayes et al.
3,821,973 A 7/1974 Carmien
3,942,567 A 3/1976 Richilano
4,039,012 A 8/1977 Cook
4,073,327 A * 2/1978 Pearson ..... B25D 1/06 81/24
4,139,930 A 2/1979 Cox
4,183,385 A * 1/1980 Burkybile ..... B25D 1/02 30/308.3
4,200,130 A 4/1980 Reamy
4,240,478 A 12/1980 Wilson
4,308,770 A * 1/1982 MacDonald ..... B25B 13/481 81/177.2
4,373,565 A 2/1983 Soto
D271,275 S 11/1983 Richilano
4,773,286 A 9/1988 Krauth
D303,208 S 9/1989 Chung
5,027,677 A 7/1991 Rallo
5,046,387 A 9/1991 Levake
5,142,948 A * 9/1992 Liou ..... B21K 5/14 76/103
5,216,939 A 6/1993 Swenson
5,768,956 A 6/1998 Coon
D408,702 S 4/1999 Hammond
D415,003 S 10/1999 Freeman
6,016,722 A 1/2000 Gierer et al.
6,176,156 B1 1/2001 Coonrad
6,227,075 B1 5/2001 Carmien
6,282,988 B1 9/2001 Erickson
6,332,376 B1 12/2001 Hurley
6,435,059 B1 8/2002 Martinez
6,457,384 B1 10/2002 Cox et al.
6,463,832 B1 10/2002 Cox
6,477,922 B1 * 11/2002 Burnett ..... B25D 1/00 81/20
6,536,308 B1 3/2003 Thorne et al.
6,629,684 B2 10/2003 Youngren
6,655,236 B1 12/2003 Slack et al.
6,805,206 B2 10/2004 Hanke
7,107,874 B1 9/2006 Chen
7,143,667 B2 12/2006 Deros et al.
7,168,338 B2 1/2007 Hopper, Jr. et al.
D549,064 S 8/2007 Youngren
D549,066 S 8/2007 Youngren
7,350,440 B2 4/2008 Casolco
7,467,572 B2 12/2008 Fisher et al.
7,665,390 B2 2/2010 Hoffman
7,802,497 B1 * 9/2010 Hartzog ..... B25D 1/12 81/22
8,024,994 B2 9/2011 St. John et al.
8,047,099 B2 11/2011 St. John et al.
8,104,379 B2 1/2012 Hanlon
8,117,702 B2 2/2012 Woolley et al.
8,141,458 B1 3/2012 Spencer et al.
8,261,634 B2 9/2012 St. John et al.
D672,218 S 12/2012 Youngren
D683,608 S 6/2013 Trice
8,458,838 B2 6/2013 Trice
8,534,643 B2 9/2013 Lombardi et al.
8,585,016 B2 11/2013 Woolley et al.
8,661,592 B2 3/2014 Trice
D716,628 S 11/2014 West
D730,134 S 5/2015 Youngren et al.
9,044,846 B1 6/2015 Dawson et al.
9,193,059 B2 11/2015 Lombardi et al.
2002/0112571 A1 8/2002 Pimentel
2002/0112572 A1 * 8/2002 Pimentel ..... B25G 1/01 81/20
2003/0037641 A1 2/2003 Coonrad
2004/0159489 A1 8/2004 Toda
2006/0021473 A1 * 2/2006 Deros ..... B25D 1/045 81/20
2011/0314970 A1 12/2011 Chen
2012/0112144 A1 5/2012 Hanlon
2013/0126807 A1 5/2013 Lombardi et al.
2014/0103276 A1 4/2014 Fegan
2014/0165787 A1 6/2014 Lombardi
2014/0259695 A1 9/2014 Guynn et al.
2014/4025969 9/2014 Guynn et al.
2015/0251302 A1 9/2015 Flosi et al.
2016/0039078 A1 2/2016 West

FOREIGN PATENT DOCUMENTS

FR 1573992 A 7/1969
FR 2523020 A2 9/1983
GB 1316135 A 5/1973
JP 3151153 U 6/2009
WO 2015134107 A1 9/2015
WO WO 2015134106 A1 9/2015
WO 2016022594 A1 2/2016

OTHER PUBLICATIONS

International Search Report and Written Opinion issued in PCT application No. PCT/US2014/072951, dated Apr. 27, 2015, 9 pages.
Office Action, U.S. Appl. No. 14/587,452 dated Feb. 16, 2017, 12 pages.

* cited by examiner

ALUMINUM STRIKING TOOLS

CROSS REFERENCE TO RELATED APPLICATIONS

This application claims the benefit of U.S. Provisional Application Ser. No. 61/949,834, filed Mar. 7, 2014, which is incorporated herein by reference.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Background

The present invention relates generally to aluminum alloy striking tools with heads having a striking surface attached thereto.

2. Description of the Background

As depicted in FIGS. 1 and 1A, a basic striking tool 10, for example, a claw or framing hammer, includes a grip 12 disposed on a bottom section of a handle 14 that further includes a handle neck 16. Opposite of the grip 12 is a head 18. The head 18 includes a neck 20 and a poll 22 with a striking surface 24 having a beveled edge or chamfer 26. Opposite of the poll 22, an accessory 28 or claw portion is disposed. The accessory or claw portion 28 may include a feature 30 such as a split or orifice that enables a user to remove nails (not shown) from a board (not shown) and the like.

Often, hammers like those shown in FIGS. 1 and 1A are of steel construction which is necessitated by the forces required to drive and remove nails, remove studs during demolition and rehab, and similar endeavors. However, such steel construction, while providing greater durability, also makes for very heavy tools that quickly fatigue a user when used for extended periods of time.

One approach to overcome the heavy construction of steel hammers has been to construct the hammer, at least in part, of a lighter material, such as wood or fiberglass, which was used for the handle, as such materials are not capable of being struck repeatedly against nails and the like without failure. More recently, other lighter weight hammer designs have included a head made of titanium or titanium alloy, with a hard striking surface or working tip attached thereto by a threaded connector, welding, brazing, adhesives, or shrink fitting (heat treatment).

Aluminum has also previously been used in the construction of lightweight hammers, however, such hammers have not been designed for the strenuous activities for which steel hammers are typically used because of durability issues. For example, aluminum hammers cast in a sand mold have been made as "soft" head hammers for the purpose of driving parts without damaging the parts being driven.

Another example combines an aluminum alloy handle with an all-steel head. The head is attached to the handle by means of an adapter arrangement that includes a split sleeve construction provided by a pair of adapter sleeve halves each with an inner recess and adapted to form an opening when assembled together to mate with a complementary shaped end portion of the hammer handle. The outer contour of the adapter sleeve halves are, in turn, configured to mate with a tapered opening in a central region of a hammer head.

However, oftentimes such lighter weight tool constructions have resulted in short-lived tools unable to withstand the same forces as all-steel hammers. Moreover, many of these designs have not been able to reduce the weight of the head of the striking tool, and thus, have had little effect in reducing the fatigue experienced by the user when used for extended periods. There is a need, therefore, for light weight striking tools with durable construction that provide greater ease of use and prolonged tool life.

SUMMARY OF THE INVENTION

According to one aspect, a striking tool includes a handle with a first end and a second end, an aluminum head disposed on the second end and including a receiving surface, and a cap including a striking surface and a mounting surface. The cap is permanently affixed to the head by a bushing disposed between the receiving surface and the mounting surface.

According to a second aspect, a striking tool includes a handle with a first end and a second end, an aluminum head disposed on the second end and including a receiving surface, a cap including a striking surface and a mounting surface, and an accessory affixed to the head opposite of the receiving surface comprising a mounting feature.

According to a third aspect, an aluminum alloy striking tool includes a handle with a first end and a second end, and a head disposed on the second end and including a striking surface. The head is integrally formed with the handle. The striking tool is adapted to withstand up to 50,000 blows against a surface having a hardness of HRC 40 delivered with a torque of 60 in-lbs at the head.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

Figure 1:
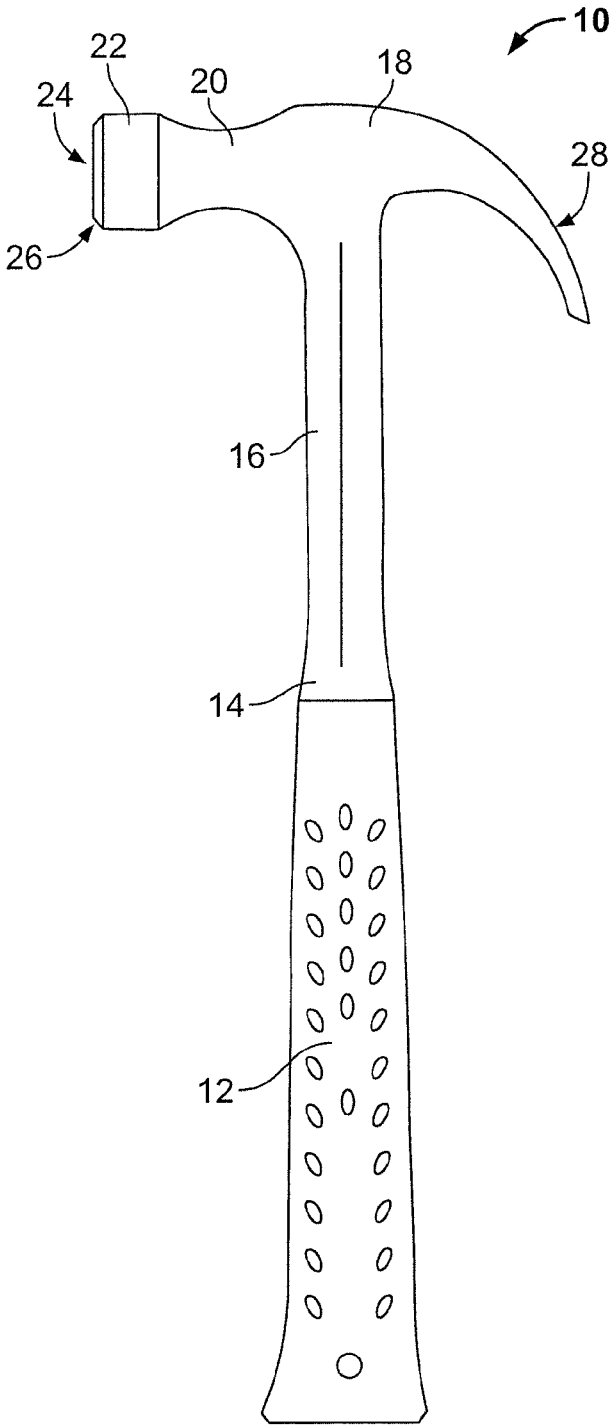
FIG. 1 (PRIOR ART)
FIG. 1 is a side elevational view of a first embodiment of a striking tool according to one embodiment.
Figure 1A:
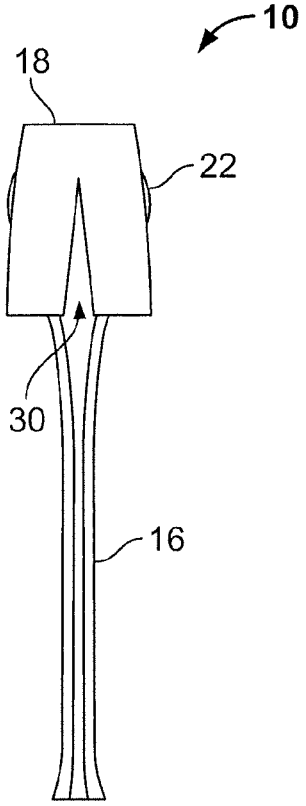
FIG. 1A (PRIOR ART)
FIG. 1A is a rear elevational view of a top portion of the striking tool of FIG. 1.

To overcome the deficiencies of the prior art, the present disclosure is directed to a striking tool 10 that improves upon the concepts of FIGS. 1 and 1A by forming, for example, an aluminum-bodied hammer that may have one or more striking surfaces attached to the head 18 as well as a claw portion 28 and/or other tool accessory, such as an axe blade, saw, knife, spike, chisel, peen, and combinations thereof. In this way, contemplated striking tools 10 include a nail hammer with nail pulling claw, a nail hammer with board straightening claw, a bricklayer head having a striking face and chisel for use on brick or concrete, a rock pick head having a striking face and pick or chisel and pick, and/or an axe head having at least one bladed edge with the option of a striking surface or pick. The striking surface 24 and other accessories may be made of a separate material and attached to the hammer body by means including a pin, a threaded connection, shrink fitting, welding, brazing, adhesives, and the like, or as otherwise disclosed below. Herein, like structures are referred to with the same reference numbers. Furthermore, contemplated striking tools 10 may only include a subset of the features of striking tool 10 from FIGS. 1 and 1A and/or may include additional features.

Figure 2:
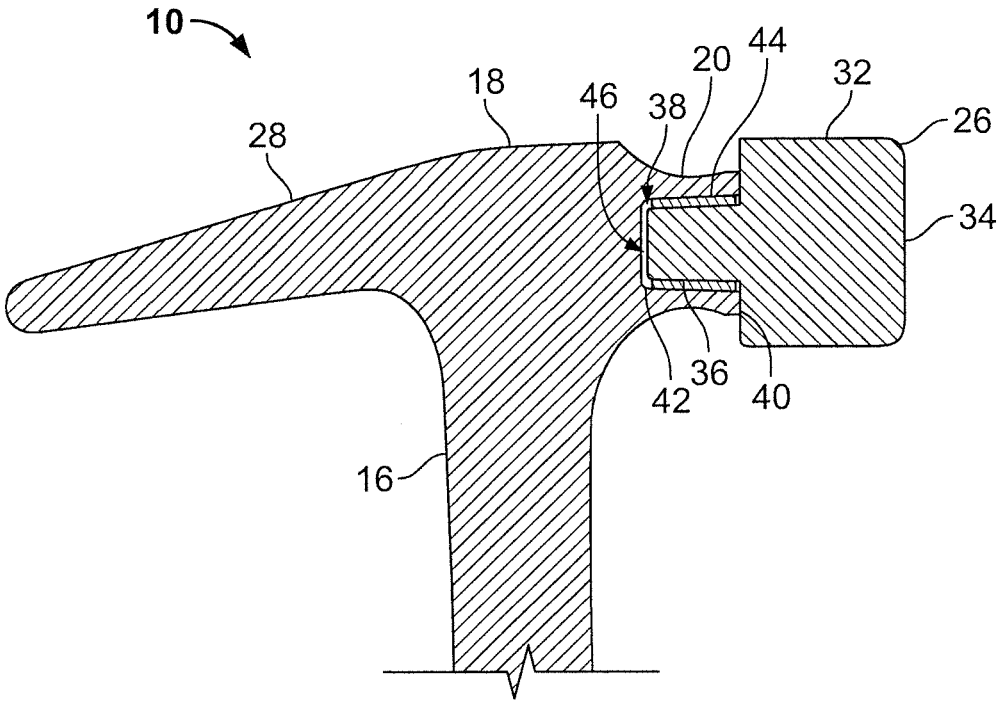
FIG. 2 is a cross-sectional left side view of a top portion of a striking tool according to one embodiment.
Figure 2A:
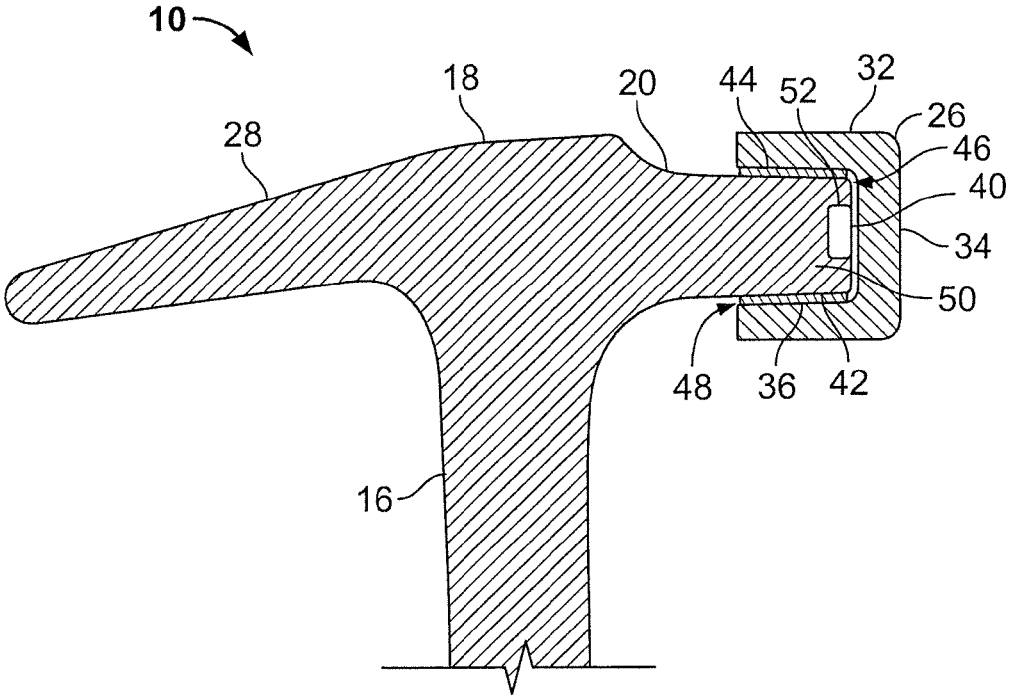
FIG. 2A is a cross-sectional side view of a top portion of a striking tool according to a further embodiment.
Figure 2B:
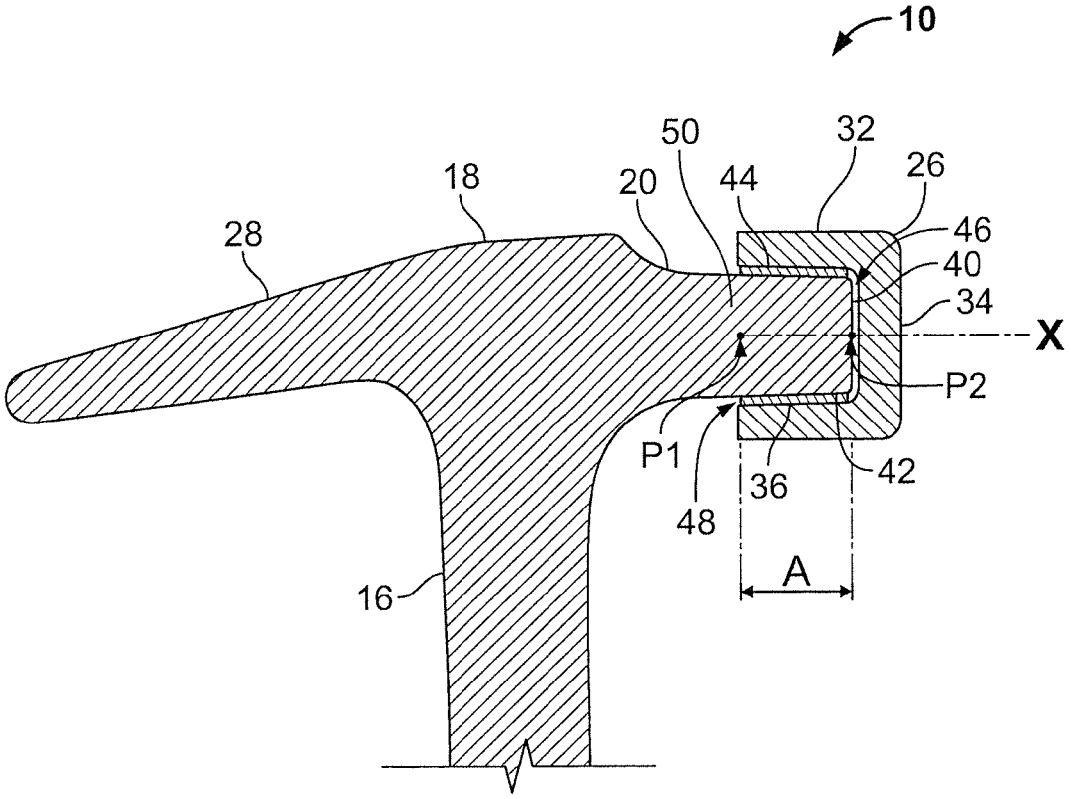
FIG. 2B is a cross-sectional side view of a top portion of a striking tool similar to the embodiment of FIG. 2A.

As seen in FIGS. 2-2B, a partial view of a contemplated striking tool 10 includes a handle neck 16, which extends from the handle and grip (not shown), that is formed from the same piece of material as the head 18. In one embodiment, the striking tool 10 is formed from an aluminum alloy. Contemplated alloys include the 2000, 4000, 6000, 7000 and 8000 series alloys. Some specific examples of possible aluminum alloys that may be used include 1050/1200, 2014A, 3103/3003, 5251/5052, 5454, 5083/5182, 6005A, 6061/6082, 6063, 7020, and 7075 aluminum. However, any aluminum alloy is contemplated herein. It is further contemplated that the aluminum may be heat treated.

In the embodiment of FIG. 2, a striking cap (cap) 32 is affixed to the head 18 of the striking tool 10. The cap 32 includes a striking surface 34 adapted for striking another surface (not shown), such as a fastener like a nail, spike, stake, staple, pin, or rivet. The striking surface 34 may also be appropriately shaped for working metal, concrete, stone, wood, etc. Opposite of the striking surface 34 is a mounting surface 36 that extends from the cap 32 and is received within a cavity 38 that extends into a face 40 of the head 18. The cavity 38 is defined by a receiving surface 42 adapted to receive the mounting surface 36 of the cap 32. Interposed between the mounting surface 36 and the receiving surface 42 is a bushing 44 that substantially surrounds the mounting surface. The bushing 44 is adapted to form a friction fit between the mounting surface 36 and the receiving surface 42 to affix the cap 32 within the cavity 38 of the head 18. The bushing 44 may be used to attach the cap 32 in combination with other means herein disclosed. For example, the bushing 44 may be used in combination with a tapered receiving surface 42 and/or a tapered mounting surface 36.

In this embodiment, force generated by impact of the striking surface 34 is transferred through the cap 32 and distributed over the mounting surface 36 through the bushing 44 to the receiving surface 42. As a result, the mounting surface 36 and the receiving surface 42 may become more tightly associated through use of the striking tool 10, and the bushing 44 may deform to some degree causing an increase in its overall surface area. The increase in surface area of the bushing 44 is believed to increase the amount of friction between the mounting surface 36 and the receiving surface 42 over time and provide an ever stronger bond between the cap 32 and the head 18.

While not wishing to be bound by theory, it is believed that the attachment of the cap 32 as depicted in FIGS. 2A and 2B (a generally concave mounting surface 36 within the cap) may be preferable to having the cavity 38 in the neck 20 of the striking tool 10 as shown in FIG. 2. In the application of a striking tool 10 used for driving a nail and the like, the striking surface 34, to be durable, must be made of a harder stronger material which will have both a higher tensile and compressive strength when compared to the material used to manufacture the head 18 of the striking tool 10. Additionally, the bearing strength of the material used to make the cap 32 will be higher than that of the material used to make the head 18. In metals, the compressive strength will typically be equal to or greater than the tensile strength. Additionally, bearing strength will be higher than either tensile or compressive strength.

If a tapered mounting surface 36 or bushing 44 surrounding the mounting surface is pressed into a cavity 38 in the neck 20, the vast majority of axial force used is directed outward generally perpendicularly to the receiving surface 42 or bearing surface of the cavity in the neck, and to a greater degree when the receiving surface is angle/tapered. The product of this force multiplied by the static coefficient of friction between the two materials of the cap 32 and head 18 and the area of engagement is the axial force required to remove the mounting surface 36 from the cavity 38 as well as the radial force required to rotate the mounting surface in the cavity.

The cap 32 will be under a bearing load since it will be under compression from all sides of the tapered cylinder (cavity 38) simultaneously. The material surrounding the cavity 38 in the neck 20 will be under a tensile load. As the tensile load exceeds the tensile strength of the material surrounding the cavity 38, the material deforms outwardly and thins around the mounting surface 36. This, in turn, leads to a reduced cross-section of the material around the cavity 38 further reducing the tensile strength of the material. If no additional force is applied, the frictional forces holding the mounting surface 36 against the receiving surface are diminished allowing for the undesirable separation of the cap 32 from the head 18. However, if additional force is applied, it is transmitted to the material having the weakened cross-sectional area around the cavity 38. As the material progressively thins, it cracks, ultimately leading to a relatively rapid failure of the striking tool 10 that can take place over the course of only a few blows of the striking tool.

Therefore, since the tensile strength will fail prior to the bearing strength of the material, it is preferred to use the stronger material having the higher tensile strength as the material that is under tensile load. Since it is desirable that the cap 32 be made of the harder, stronger material, it is then also preferred to have a cavity in the cap subjecting a softer material (e.g., aluminum alloy and the like) in the head 18 and neck 20 to the bearing load. When constructed in this manner, the frictional force holding the cap 32 onto the head 18 may actually increase with use overtime without the risk of failure of the striking tool 10.

When the cap 32 is affixed to the head 18 in this way with an appropriately sized bushing 44 or without a bushing, a first void space 46 may be formed between an inner surface of the cap and the head that provides shock absorption when the striking tool 10 is used to strike an object, and a second void space 48 may also be formed between the cap 32 and the head 18 or they may be flush once fully attached. Either or both void spaces 46, 48 may be filled with any manner of shock absorbing materials including gas, foam, fabric, rubber, plastic, wood, malleable metal, and combinations thereof. In one embodiment, the void space 46 is permanent, such that throughout the useful lifetime of the striking tool 10, the void space never bottoms out.

In another embodiment, the cap 32 is attached directly to the neck 20, such that the mounting surface 36 and receiving surface 42 are in direct contact with one another. It is further envisioned that a material may be interposed between the cap 32 and the neck 20 to facilitate manufacture, longevity, removability, shock reduction, or feel of the striking tool 10. For example, materials interposed between the cap 32 and the neck 20 may include adhesives, shock absorbing materials, weight adding materials, insulators, lubricants, and the like.

The mounting surface 36 and the receiving surface 42 may each have a cylindrical shape or may be tapered. In FIG. 2, the mounting surface 36 of the cap 32 has a slight taper as it extends from the cap (a "closing taper"), and the receiving surface 42 has a complementary taper (e.g., a similar or the same taper) as the cavity 38 extends into the face 40. In another embodiment, either the mounting surface 36 or the receiving surface 42 is cylindrical and the other is tapered in either direction. Any shape or taper that allows for affixation of the cap 32 to the head 18 is contemplated herein. For example, either or both of the mounting surface 36 and the receiving surface 42 may have a taper measured along one side thereof with an effective angle of about 10°, or about 7°, or about 5°, or about 3°, or about 1°, or less than about 10°, or less than about 7°, when measured relative to a central axis (such as seen in FIG. 2B). When the effective angle of the receiving surface 42 is measured relative to a plane formed by the face 40, the receiving surface may have an effective angle measured along one side thereof that ranges from about 80° to about 100°, or from about 83° to about 97°, or about 85° to about 95°, or about 87° to about 93°, about 89° to about 91°. Similar effective angles are contemplated for the mounting surface 36 and may similarly be determined relative to a plane formed by the striking surface 34.

In the embodiment shown in FIG. 2B, a tapered mounting surface 36 engaged directly or indirectly with a tapered receiving surface 42 will have a length of engagement (A) by which a cap 32 may be secured to a head 18 by a friction fit alone or in combination with a mechanical and/or chemical bond. The length of engagement (A) may have a central axis (X), for example, that is generally concentric with a center of the receiving surface and a center of the striking face 34 when attached to the striking tool 10. A first perimeter or circumference of engagement may be measured around the receiving surface 42 at a first point (P1) along the central axis (X) at a first end of the length of engagement (A). A second perimeter or circumference of engagement may be measured around the receiving surface 42 at a second point (P2) along the central axis (X) at a second end of the length of engagement (A). The largest perimeter or circumference of engagement may be either proximal or distal to the striking surface 34 of the cap 32. A ratio of the length of engagement (A) to the absolute value of the difference between the first perimeter measured at the first point (P1) and second perimeter measured at the second point (P2) may be greater than about 0.4, or about 0.8, or about 1.2, or about 1.5, or about 2.0, or about 2.9.

In an alternative embodiment, the first perimeter or circumference of engagement and the second perimeter or circumference of engagement may be equal.

Similarly, the bushing 44 may be configured to have a taper that may be complementary to that of either or both of the mounting surface 36 or the receiving surface 42 or may have a different configuration that still enables affixation of the cap 32 to the head 18. Further, the bushing 44 may be made of any material that allows for permanent affixation of the cap 32 to the head 18. Alternatively, the bushing 44 may allow removable affixation of the cap 32 to the head 18. The bushing 44 may be made of one or more metals, adhesives, polymers, plastics, and combinations thereof and be formed by one or more pieces of material. In one embodiment, the bushing 44 is made of single metal or metal alloy that is softer than that of the head 18 and the cap 32. Without wishing to be bound by theory, it is believed that using a softer material may provide greater manufacturing tolerance, that is, allow for dimensional variations in manufacturing of the bushing 44, cap 32 (mounting surface 36), and/or head 18 (receiving surface 42). In one embodiment, the bushing may have a hardness that is softer than at least one of the head 18 and the cap 32 or both the head and cap. In another embodiment, the bushing 44 may have the same hardness as at least one of the head material and the cap material or both the head and cap materials. Without wishing to be bound by theory, it is also contemplated that the bushing 44 be manufactured from a hardened material having a hardness equal to or greater than that of the mounting surface 36 and the receiving surface 42 when the components are precision ground or similarly shaped after forging, casting, and/or machining to form a precision mating surface. Further, when the head 18 and the cap 32 have precision mating surfaces, the bushing 44 may be optional.

In the embodiment shown in FIG. 2A, the cap 32 is concave and has a hollowed portion 48 in which the mounting surface 36 is disposed. The receiving surface 42 is disposed on an extension 50 of the neck 20, which is inserted into the hollowed portion 48 of the cap 32 to affix the cap to the head 18. In this embodiment, the bushing 44 substantially surrounds the receiving surface 42. Further, the void space 46 is formed opposite of the striking surface 34 within the cap 32. The face 40 of the neck 20 may be partially hollowed out and one or more magnets 52 may be placed therein to effectively magnetize the striking surface 34 of the cap 32. Alternatively, the cap 32 may include a magnet (not shown).

Figure 3A:
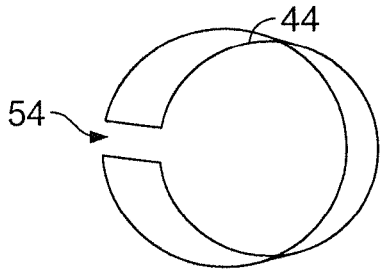
FIG. 3A is a top side elevational view of a bushing according to one embodiment.
Figure 3D:
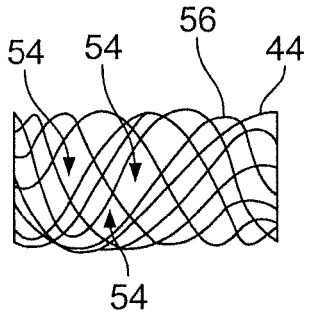
FIG. 3D is a side elevational view of a bushing according to another embodiment.
Figure 3B:
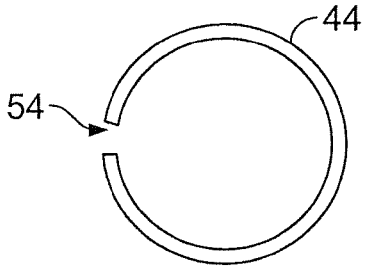
FIG. 3B is a plan view of the bushing of FIG. 3A.
Figure 3E:
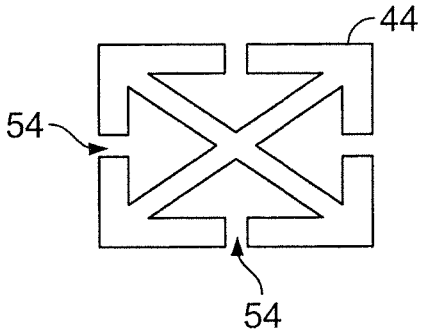
FIG. 3E is a side elevational view of a bushing according to a further embodiment.
Figure 3C:
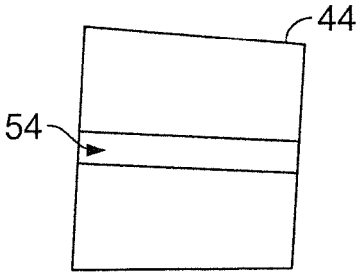
FIG. 3C is a side elevational view of the bushing of FIG. 3A.

In FIGS. 3A-C, differing views of the bushing 44 according to one embodiment are shown. In this embodiment, the bushing 44 is a solid piece with a uniform thickness, slight taper, and an open space 54 in the form of a slit extending along the length thereof. It is envisioned that the bushing 44 may have a taper independent of the mounting surface 36 or receiving surface 42 of any desired angle. The open space 54 enables the bushing 44 to deform during use of the striking tool 10 and increase its surface area and corresponding bond between the cap 32 and the head 18.

Figure 3F:
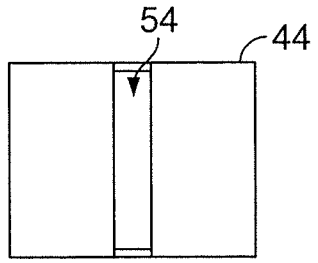
FIG. 3F is a top plan view of the bushing of FIG. 3E.
Figure 4:
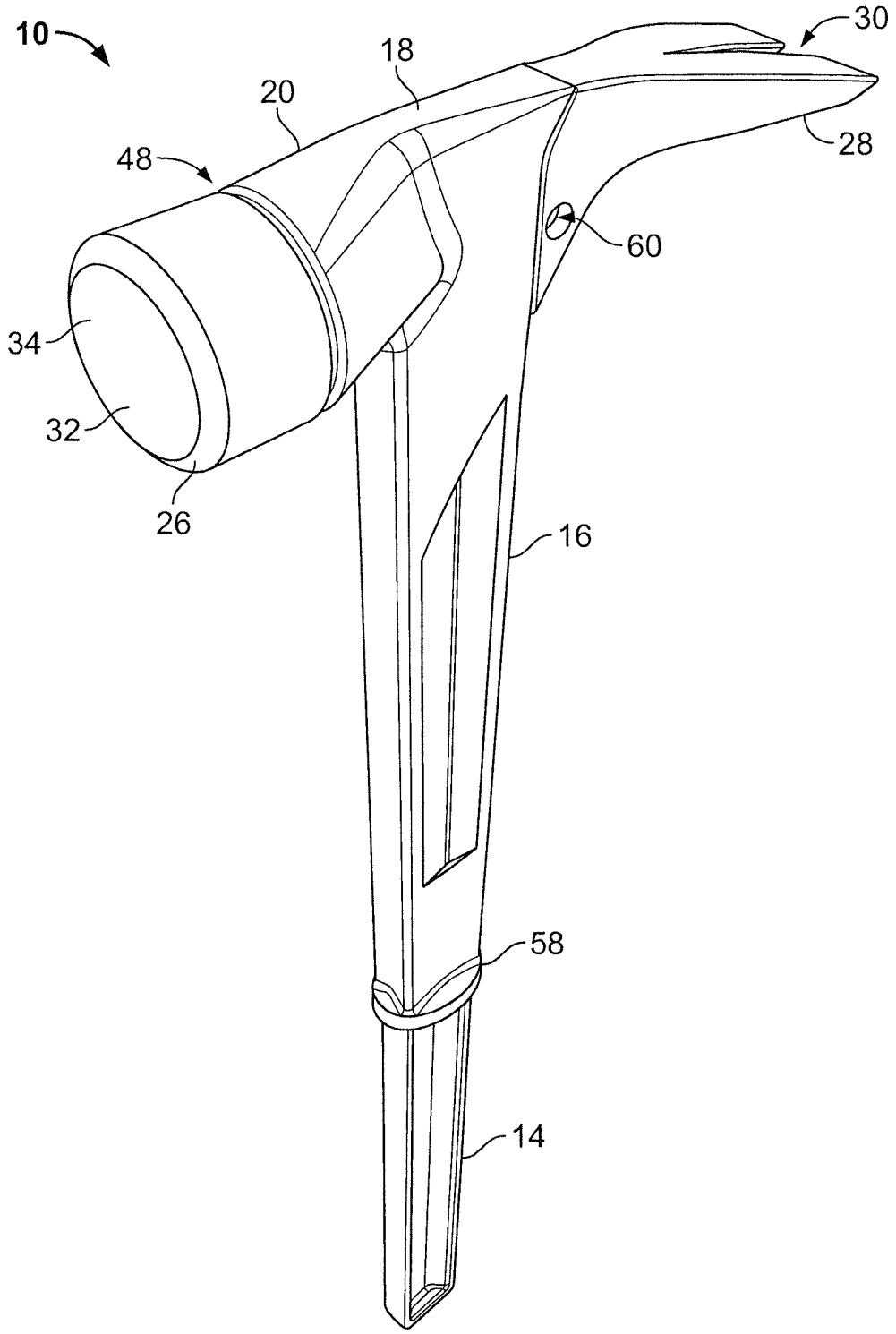
FIG. 4 is an isometric view of a striking tool according to another embodiment.
Figure 5:
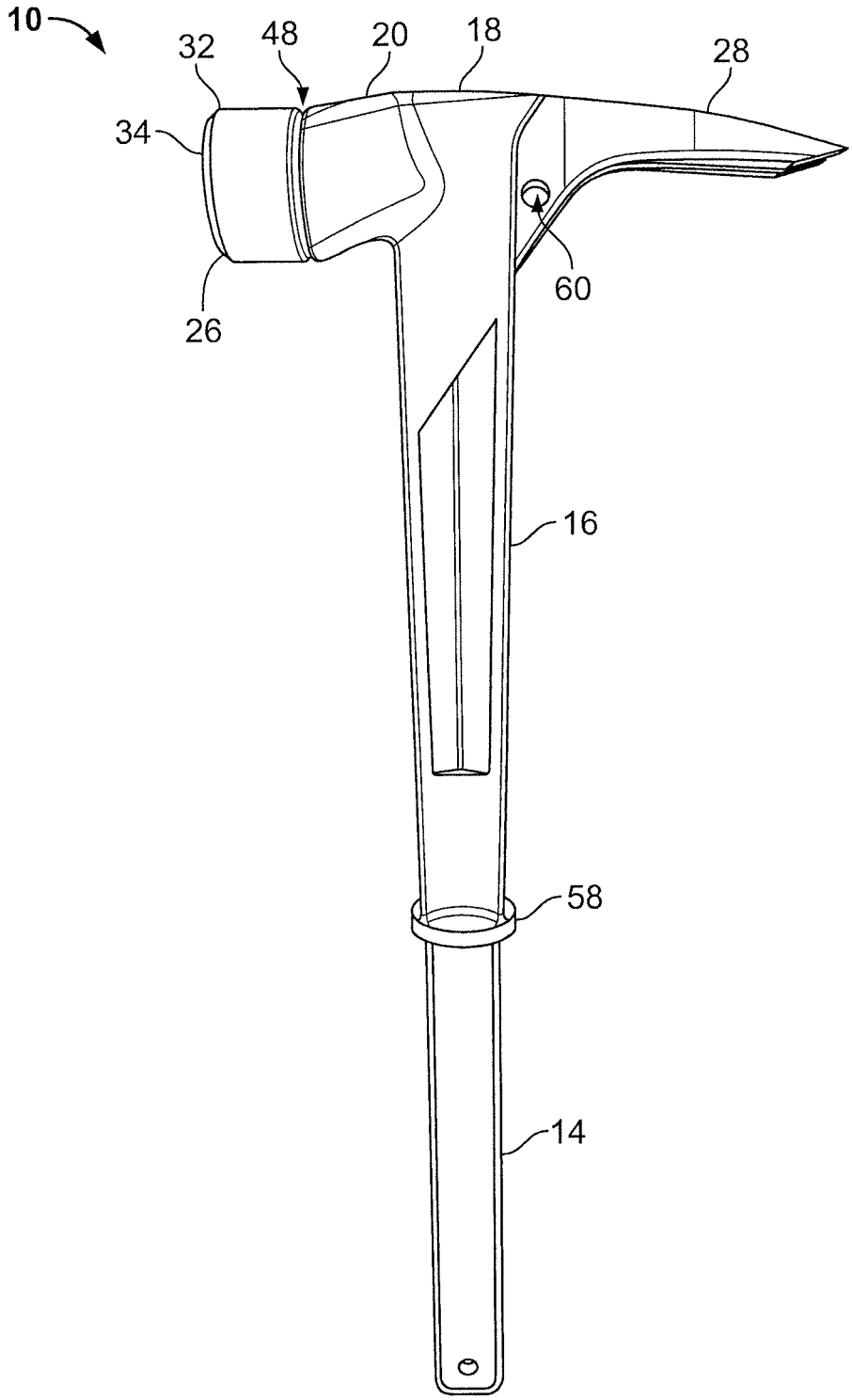
FIG. 5 is a left side elevational view of the striking tool of FIG. 4.
Figure 6:
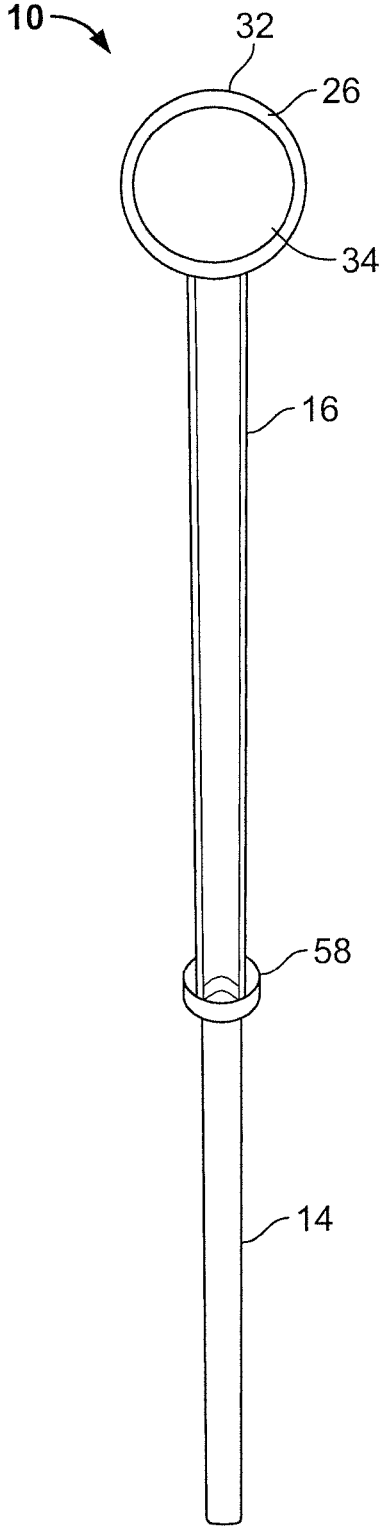
FIG. 6 is a front elevational view of the striking tool of FIG. 4.
Figure 7:
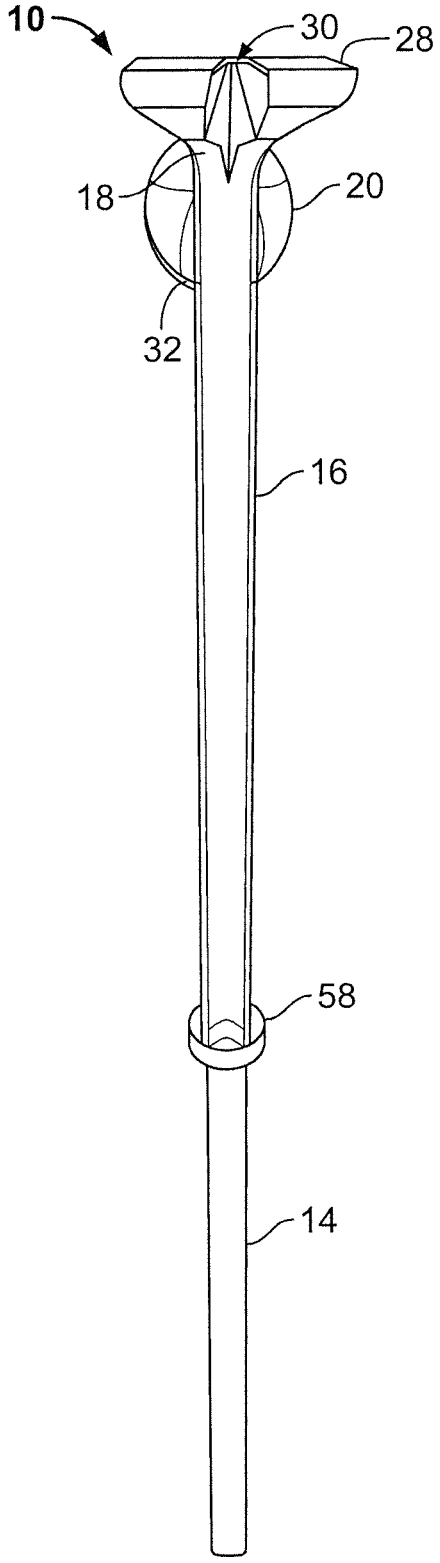
FIG. 7 is a rear elevational view of the striking tool of FIG. 4.
Figure 8:
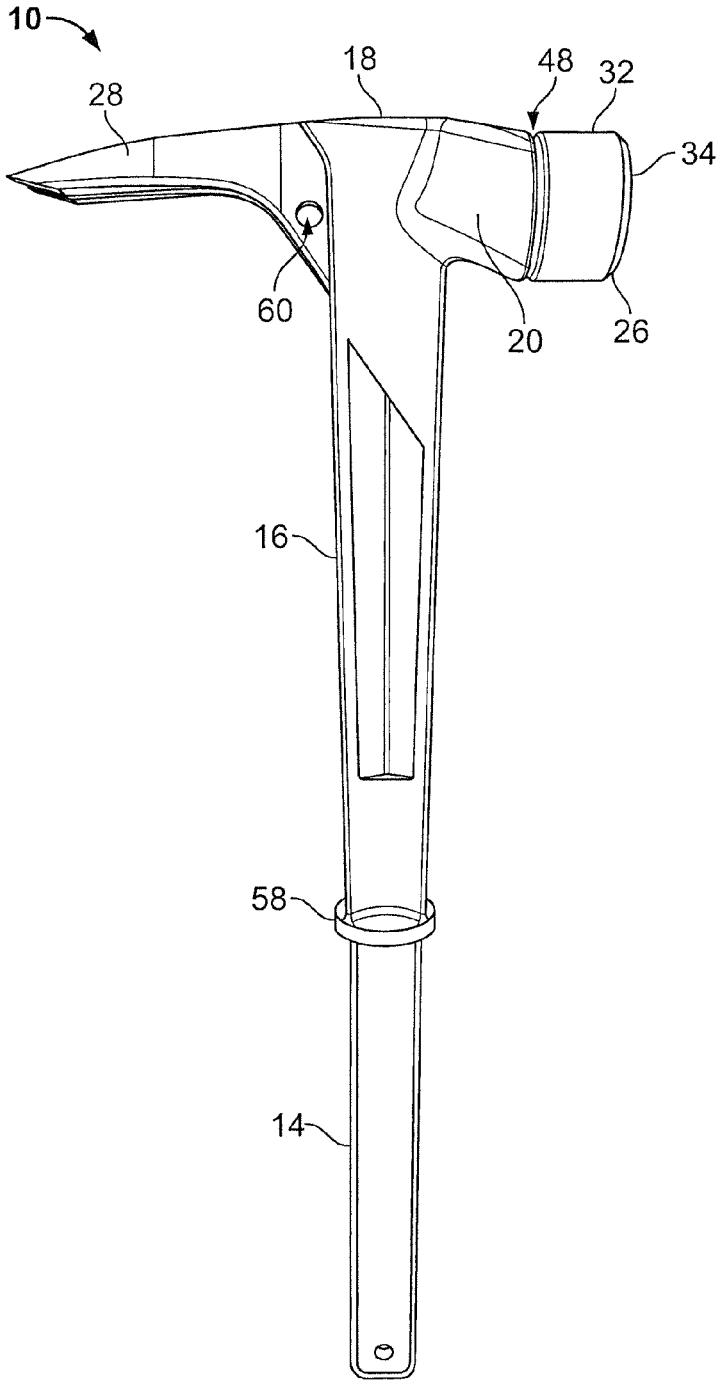
FIG. 8 is a right side elevational view of the striking tool of FIG. 4.
Figure 9:
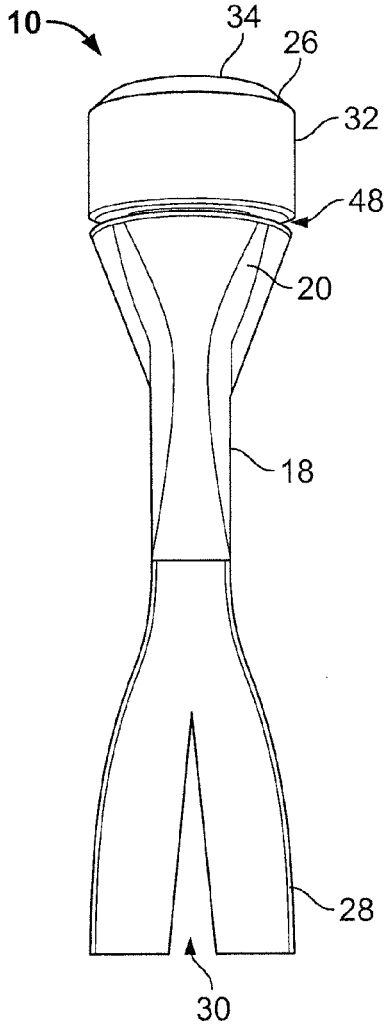
FIG. 9 is a top plan view of the striking tool of FIG. 4.

In FIGS. 3D-F, two additional embodiments of bushings are shown. In FIG. 3D, the bushing 44 has a mesh-like configuration with interwoven strands 56 of material between which are interspersed open spaces 54. FIGS. 3E and F illustrate a variation of the cylindrical bushing 44 shown in FIGS. 3A-C. Here, the bushing 44 has several open spaces 54 that allow for greater expansion of the bushing as greater force is applied thereto during use.

In one embodiment shown in FIGS. 4-9, a one-piece (head and handle) aluminum-bodied hammer is shown than incorporates a striking cap (cap) 32 that is affixed to the head 18 of the striking tool 10. This embodiment is shown without a grip portion; however, examples of grip portions that may be used are disclosed below and generally known in the art. In one embodiment, the grip may be formed or molded onto the handle 14, and a shoulder 58 may be used to form a stop or a seal during the forming process. An accessory 28 (in this case, a claw) may be attached, for example, by press fitting an oval- or oblong-shaped pilot (not shown) disposed on the accessory into a secondary receiving surface (not shown). A mounting feature 60 on the accessory 28 may be used to secure the accessory to the handle neck 16 and/or head 18.

Figure 10A:
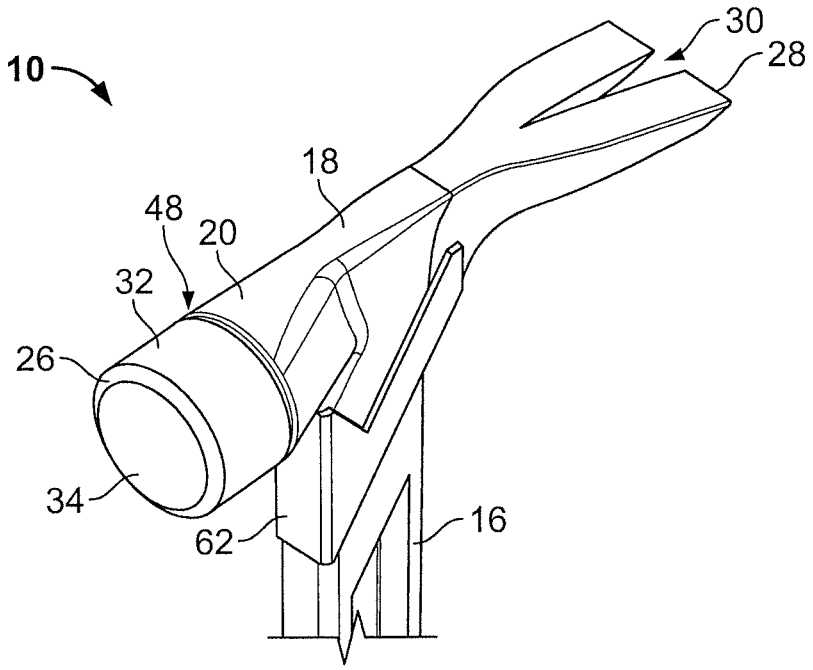
FIG. 10A is an isometric view of a top portion of a striking tool according to one embodiment.
Figure 10B:
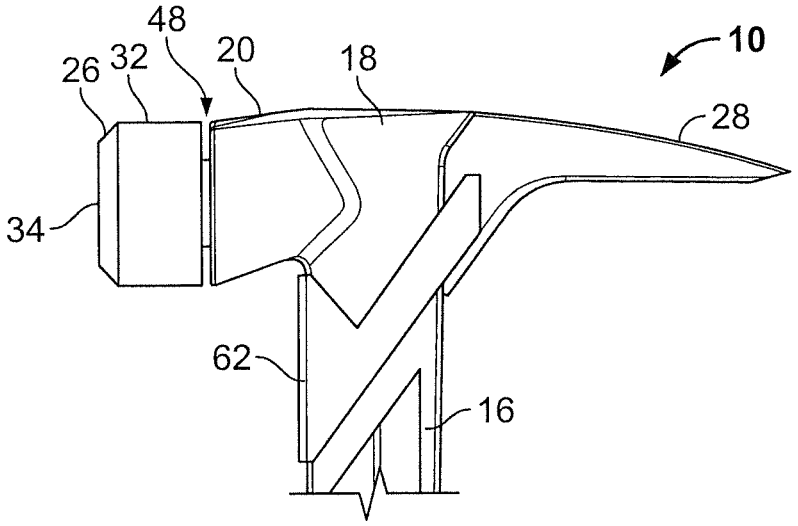
FIG. 10B is a side elevational view the top portion of the striking tool of FIG. 10A.
Figure 11A:
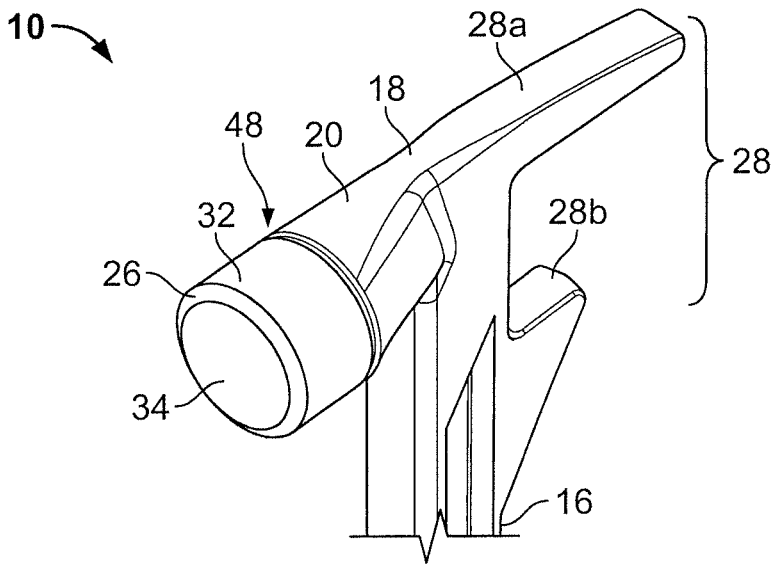
FIG. 11A is an isometric view of a top portion of a striking tool according to one embodiment.
Figure 11B:
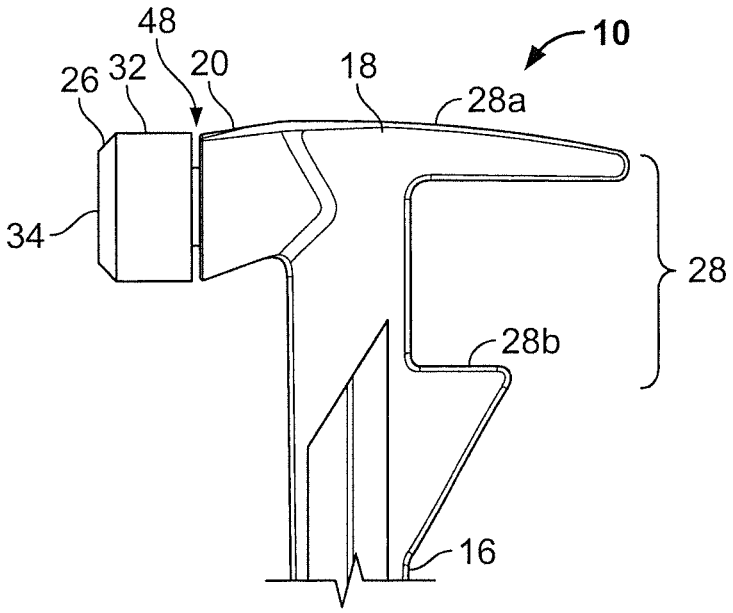
FIG. 11B is a side elevational view the top portion of the striking tool of FIG. 11A.
Figure 12A:
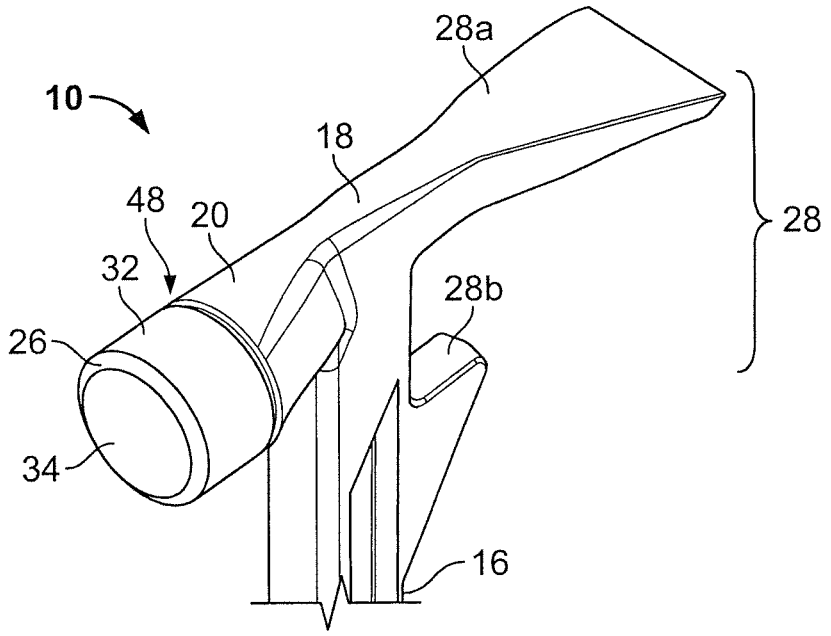
FIG. 12A is an isometric view of a top portion of a striking tool according to one embodiment.
Figure 12B:
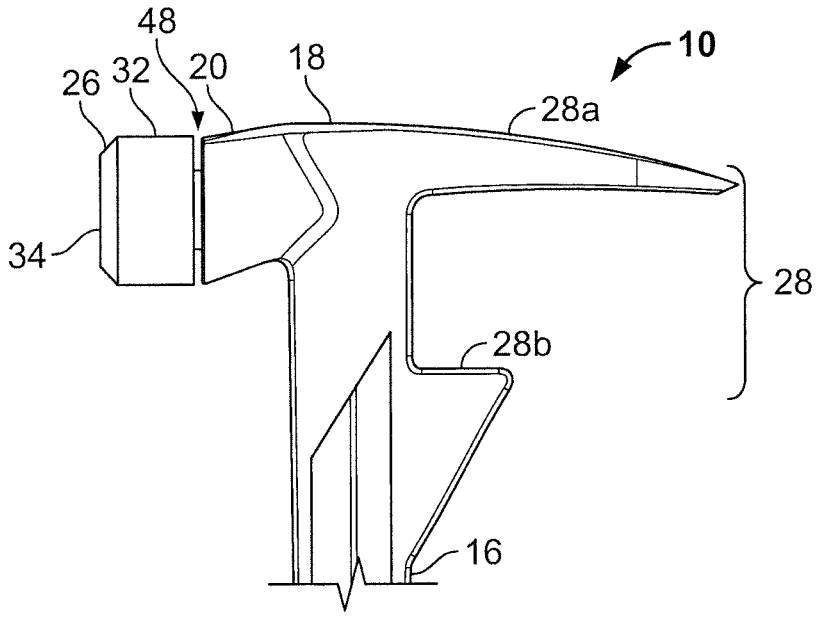
FIG. 12B is a side elevational view the top portion of the striking tool of FIG. 12A.
Figure 13A:
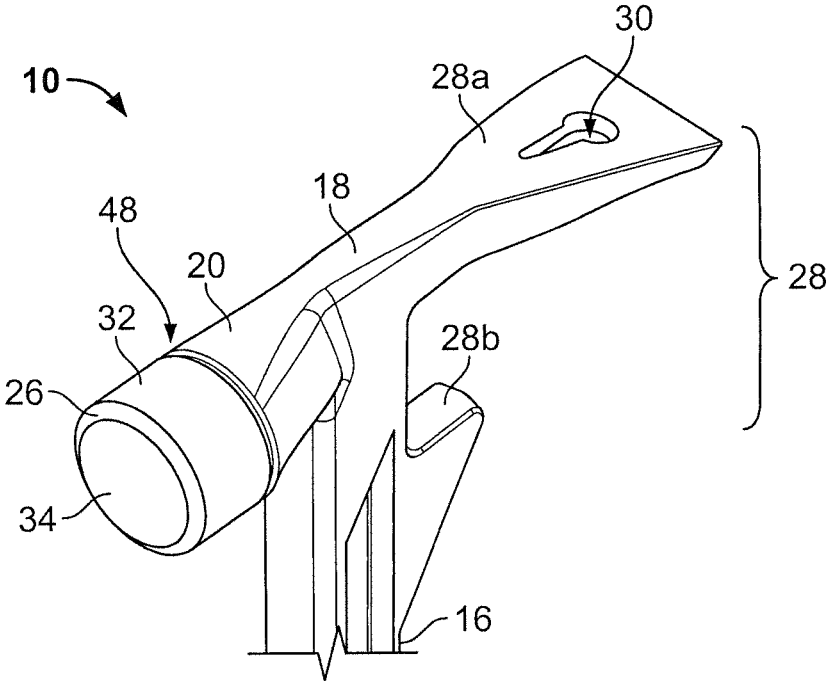
FIG. 13A is an isometric view of a top portion of a striking tool according to one embodiment.
Figure 13B:
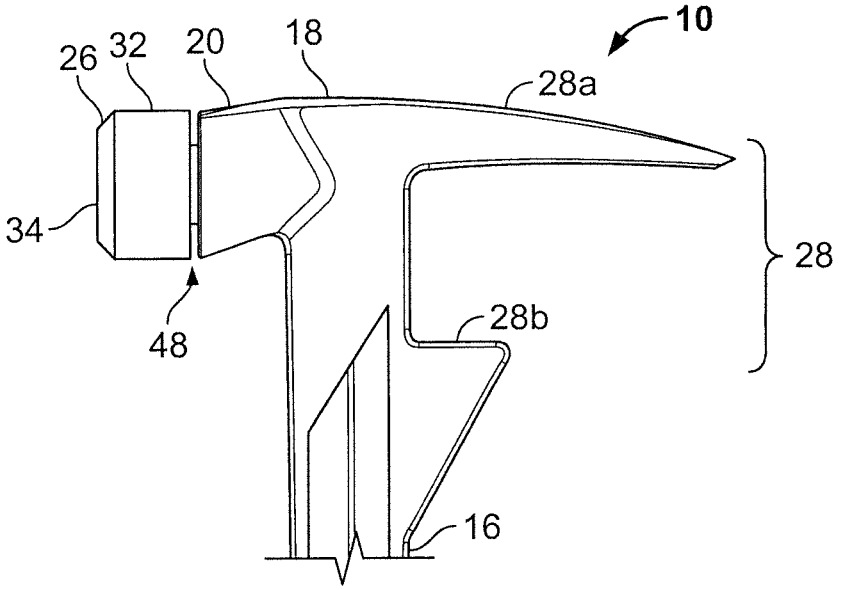
FIG. 13B is a side elevational view the top portion of the striking tool of FIG. 13A.
Figure 14A:
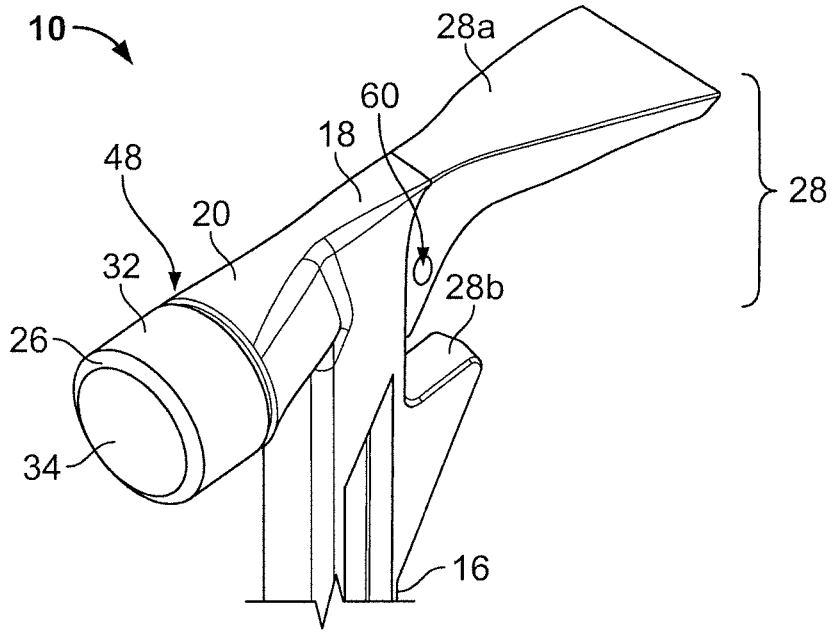
FIG. 14A is an isometric view of a top portion of a striking tool according to one embodiment.
Figure 14B:
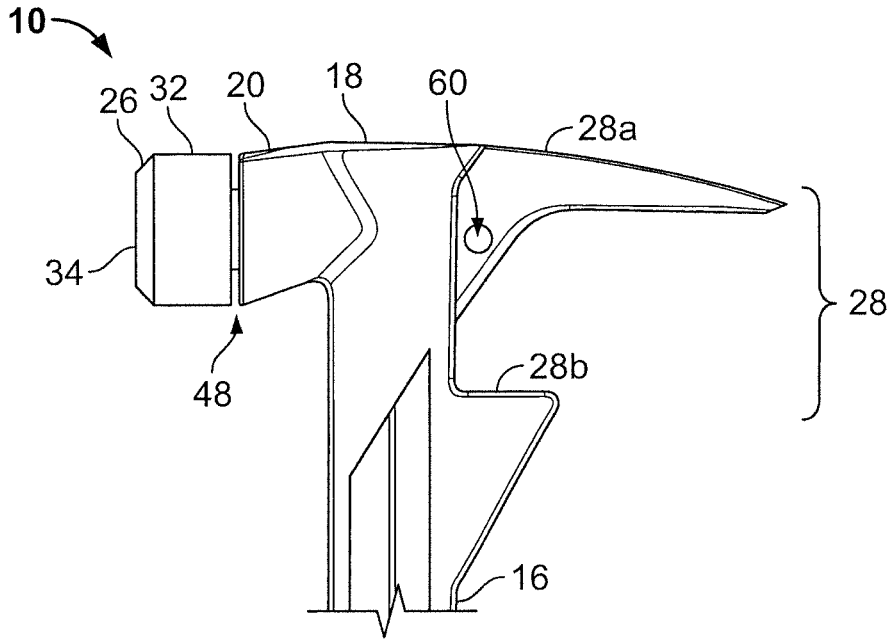
FIG. 14B is a side elevational view the top portion of the striking tool of FIG. 14A.
Figure 15A:
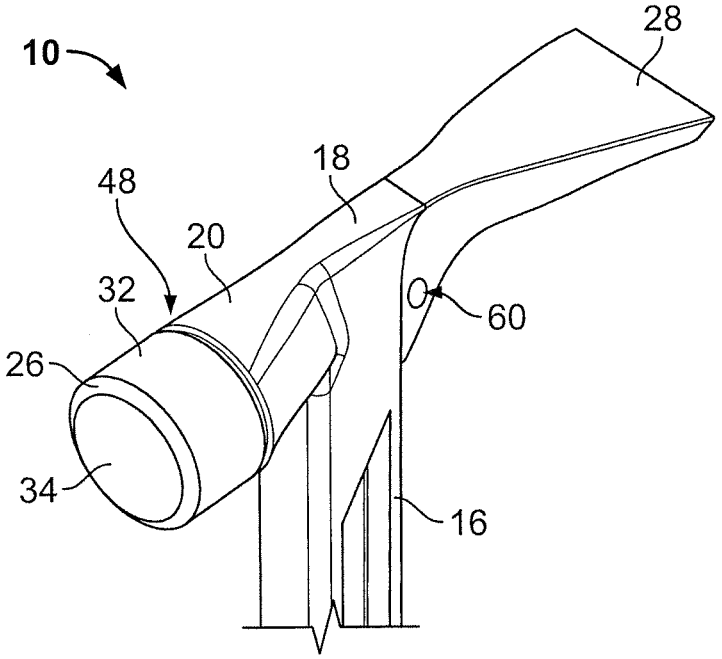
FIG. 15A is an isometric view of a top portion of a striking tool according to one embodiment.
Figure 15B:
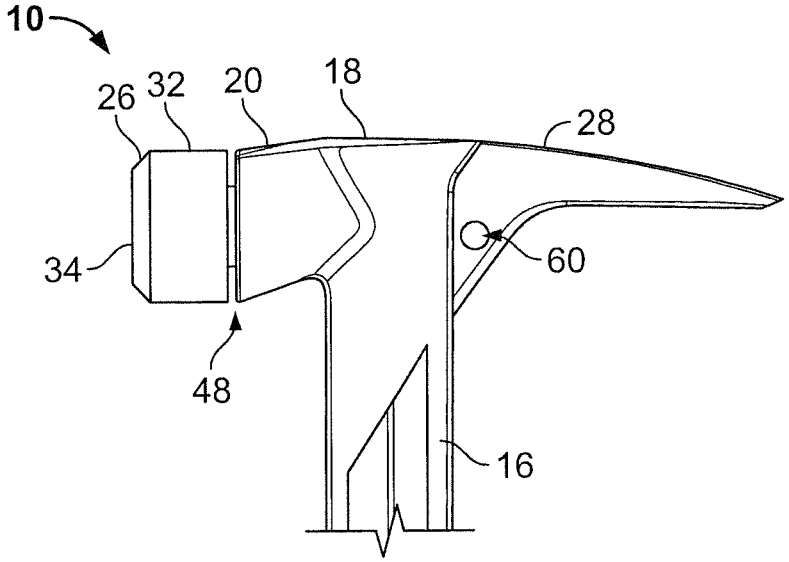
FIG. 15B is a side elevational view the top portion of the striking tool of FIG. 15A.

In one embodiment seen in FIGS. 10A and 10B, which is similar to that in FIGS. 4-9, a mounting bracket 62 secures the accessory 28 to the striking tool 10 along the head 18 and handle neck 16. The mounting bracket 62, in this embodiment, further functions as an overstrike guard to protect the handle neck 16 from striking an unintended object. Moreover, the mounting bracket further functions to transfer load to the handle neck 16 when accessory 28 is used for tasks such as prying or pulling nails.

Additional accessories 28 are contemplated herein that may be separately and/or integrally formed with the head 18 and/or handle neck 16 and used for multiple tasks including leveraging, prying, and/or striking a surface. For example, FIGS. 11A-14B illustrate striking tools 10 that incorporate a lumber manipulating accessory 28, that includes a top portion 28*a* and a bottom portion 28*b*. The top portion 28*a* may include a blunted tip (FIGS. 11A and 11B) or include a chisel edge (as seen in FIGS. 12A-14B), though other shapes and striking surfaces are also contemplated. The bottom portion 28*b* may be integral with the handle neck 16. Alternatively, the lower portion 28*b* may be similarly press fit into the handle neck 16 and secured by a mounting bracket (not shown). The lower surface of the top portion 28*a* and the upper surface of the bottom portion 28*b* may each be relatively smooth (as shown, for example, in FIG. 11B) or may include teeth and/or other gripping surface features (not shown) to facilitate improved grip on a piece of wood or other material held therebetween. It is further contemplated that the top portion 28*a* may include a feature 30 such as a split or orifice that enables a user to remove nails and the like.

Figure 16A:
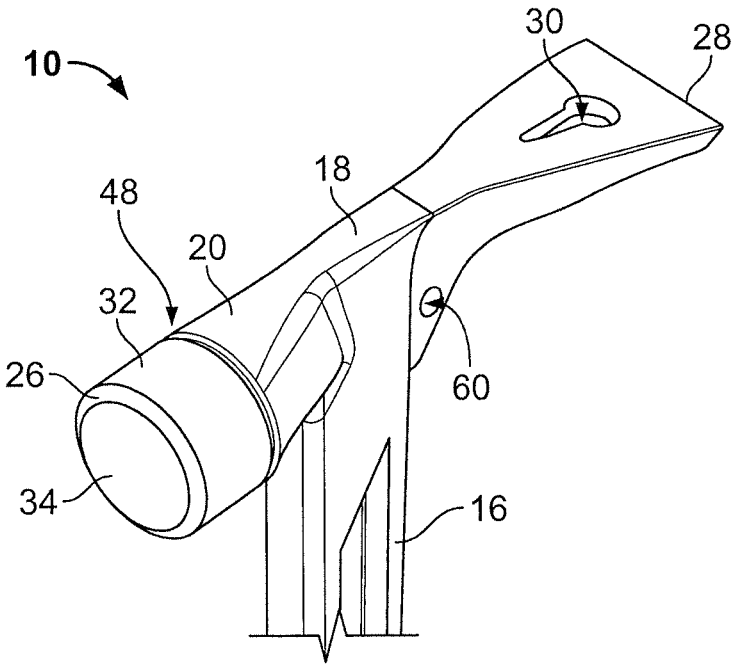
FIG. 16A is an isometric view of a top portion of a striking tool according to one embodiment.
Figure 16B:
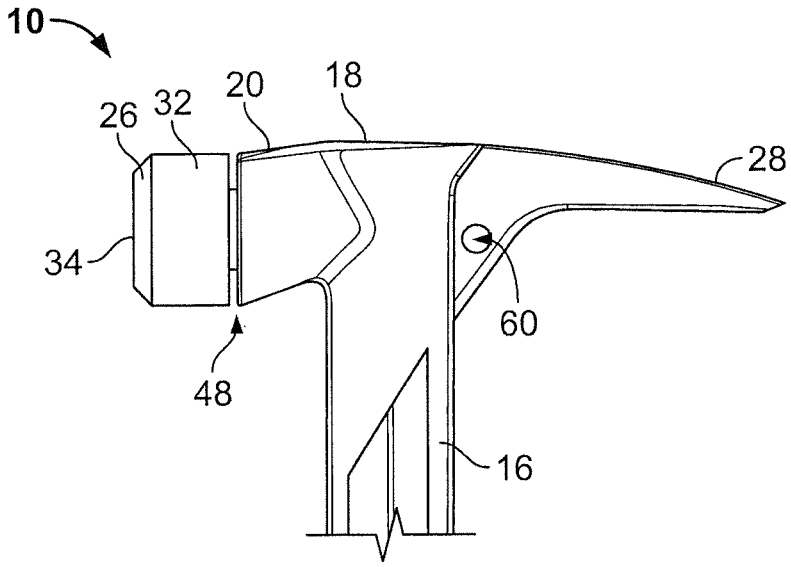
FIG. 16B is a side elevational view the top portion of the striking tool of FIG. 16A.
Figure 17A:
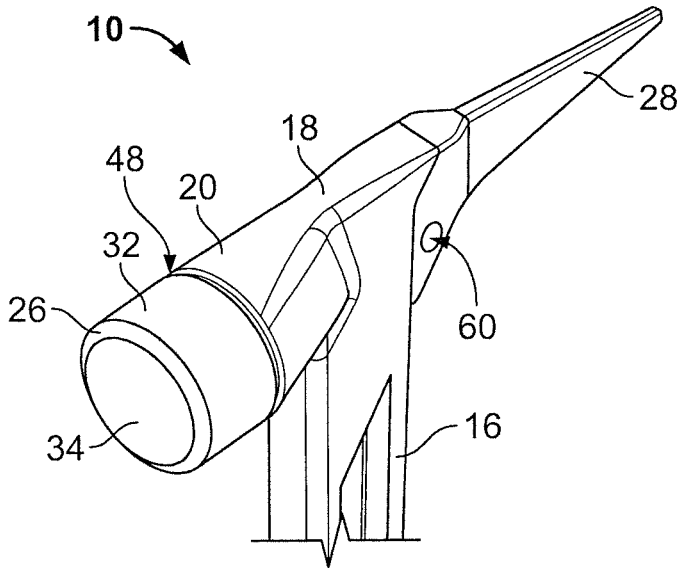
FIG. 17A is an isometric view of a top portion of a striking tool according to one embodiment.
Figure 17B:
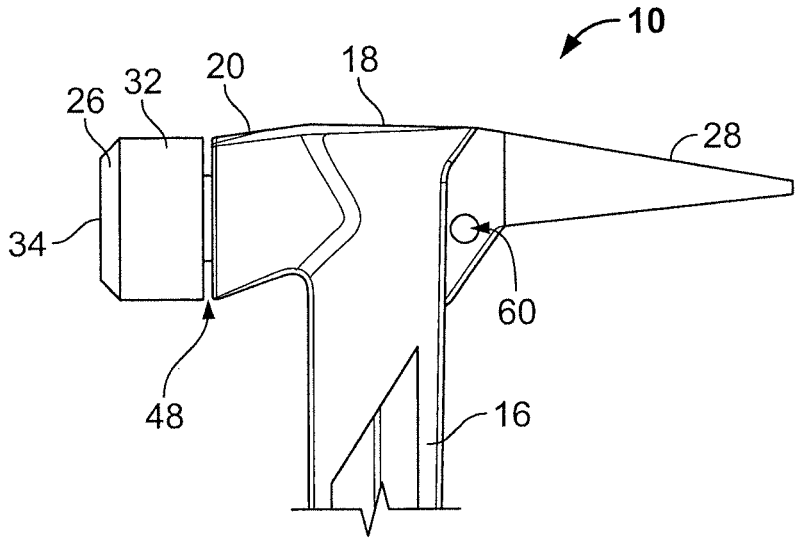
FIG. 17B is a side elevational view the top portion of the striking tool of FIG. 17A.
Figure 18A:
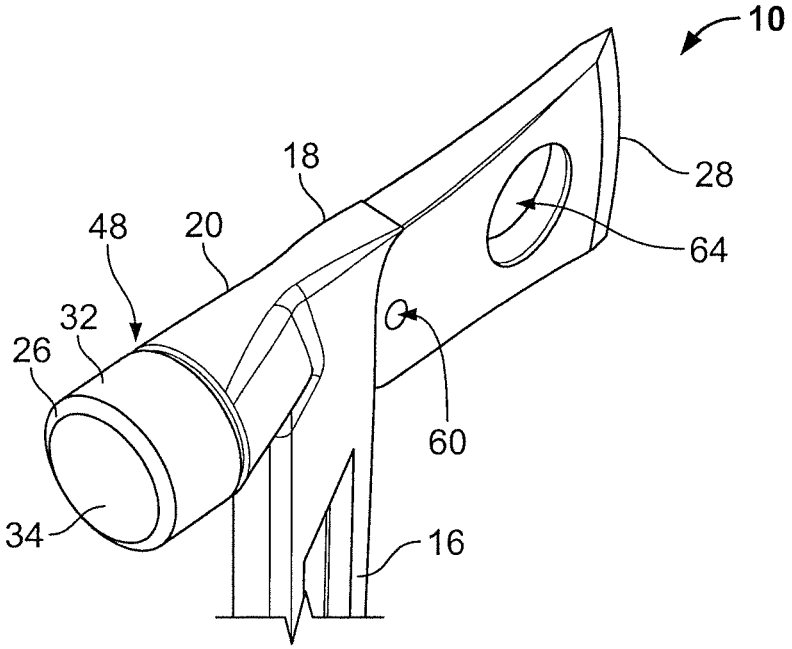
FIG. 18A is an isometric view of a top portion of a striking tool according to one embodiment.
Figure 18B:
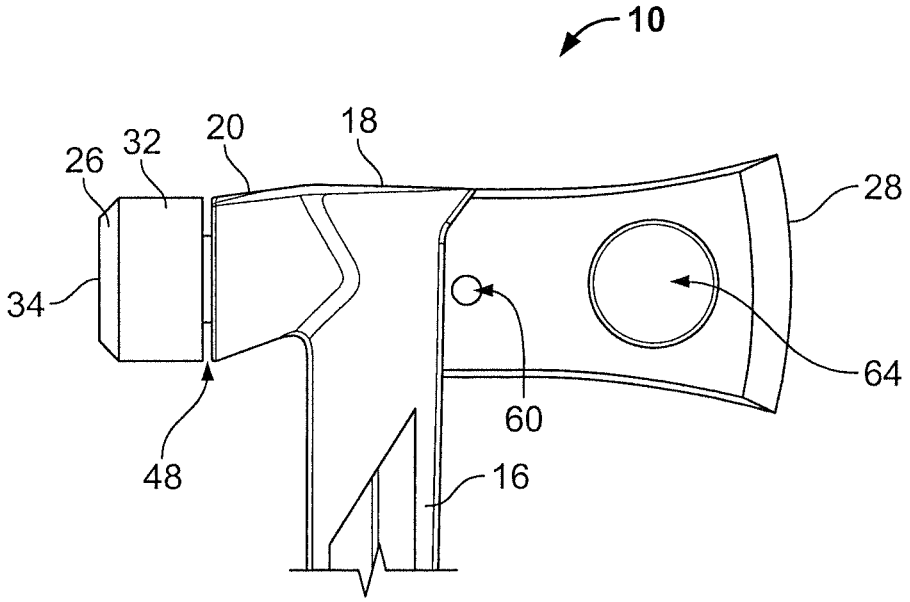
FIG. 18B is a side elevational view the top portion of the striking tool of FIG. 18A.

FIGS. 15A-16B illustrate the incorporation of a chisel-shaped accessory 28, with the accessory of FIGS. 16A and 16B including an orifice 30 for removing nails and the like. FIGS. 17A and 17B illustrate another accessory 28 in the form of a pick or pointed tip. FIGS. 18A and 18B illustrate one embodiment of an accessory 28 in the form of an axe bit. The accessory 28 of FIGS. 18A and 18B further includes a void space 64 where material has been removed to further decrease the weight of the accessory without compromising its strength. Accessories 28 may be made from any material, such as, for example, the same materials as may be used for the cap 32.

In addition to the embodiments shown in the figures, any combination of accessories 28 for striking tools 10 is contemplated herein.

Additional materials that may be used for the striking tools 10 contemplated herein include metals, polymers, plastics, composites, wood, carbon fiber, graphite, fiberglass, foam, rubber, leather, and combinations thereof. Metals contemplated include, among others, titanium, aluminum, steel, and alloys thereof. A material may be selected based on its varying degree of hardness, malleability, strength, and weight. Further materials contemplated for use herein include polymers and metal alloys and superalloys suitable for additive manufacturing.

In one embodiment, a contemplated striking tool (not shown) may include an overmold of a polymeric or similar material to provide greater strength to the underlying core. For example, an aluminum alloy one or two-piece striking tool may have a polymer overmolded onto a portion of the striking tool to provide greater strength to the striking tool and allow for a reduction in the amount of metal and accompanying weight required for construction of the tool.

In another embodiment, the handle 14 may include a core made of one material, such as an aluminum alloy and an overlay or laminate (not shown) of the same or a different material or a laminate of multiple materials. In another embodiment, the grip 12 may be formed or molded over the overlay material. For example, the overlay may be plastic, carbon fiber, fiberglass, wood, graphite, or combinations thereof. The overlay may be formed by extruding, molding, laminating, dipping, printing, and any other process known in the art. Such constructs are envisioned to allow for a lighter construction of the striking tool to reduce fatigue of a user during use as well as increase swing speed. Moreover, with lighter weight construction, striking tools 10 may have an increased handle length to generate greater force when swung by a user with little to no increased effort needed as compared to, for example, an all steel striking tool of the same length.

The handle 14 and/or head 18 may be formed by casting, fine blanking, plasma cutting, electrochemical machining, electrical discharge machining, metal injection molding, forging, rolling, extruding, milling, molding, die cutting, a computer numeric controlled machining operation, additive manufacturing, such as 3D printing, selective laser sintering, fused deposition modeling, or direct metal laser sintering or any other machining or manufacturing process suitable for a particular material incorporated into the striking tool.

The grip 12 may be made of any suitable material or combinations of material, such as leather, plastic, rubber, wood, foam, an elastomeric material, and a vibration reducing grip material. In one embodiment, the grip material may have a Shore A durometer of from about 40 to about 80, or about 50 to about 75, or about 63 to about 73, or about 60, or about 65, or about 68. Grip materials contemplated for use also include those disclosed in U.S. Pat. No. 6,465,535.

Caps 32 contemplated herein may be formed of any suitable material or combinations of material and have any shape. For example, the cap 32 may be formed of metal, plastic, rubber, and combinations thereof, such as, for example, a rubber- or plastic-tipped cap with a metal or plastic base. In one embodiment, the cap 32 has a hardness greater than that of the head 18. In another embodiment, the cap 32 has a hardness equal to or less than the head 18.

Specific striking tools 10 contemplated herein include, for example, a nail hammer, an axe, a hatchet, a splitting tool, a welding chipping hammer, a drilling hammer, a sledge hammer, a tinner's hammer, an engineer's hammer, a cross peen hammer, a ball peen hammer, a lineman's hammer, a mason's hammer, a drywall hammer, a roofing hammer, a rock pick, an adze, a deadblow hammer, a tack hammer, a soft faced hammer, or any other tool used to strike a surface.

Due to the considerable stress striking tools 10 undergo during use, they must be able to withstand certain forces in order to be commercially viable as well as safe. Indeed, AMSE B107.400-2008 sets forth the minimal standards for striking tools. One process for ensuring longevity and safety is to perform a strike test. Under the ASME test, a striking tool must be able to withstand 20 full swinging blows by a person of average build, 160 lb to 180 lb, or the mechanical equivalent, commensurate with the end weight of the striking tool. Similarly, such striking tools must be able to withstand material fatigue which can cause the tools to fail and lead to injury. For example, a well-made, all-steel hammer swung with about 60 in-lbs of torque at the head may withstand more than around 50,000 blows (strikes) on a striking surface having a hardness of about HRC 40. Therefore, a non-steel, striking tool that can withstand 50,000 blows on such a striking surface would demonstrate exceptional resistance to material fatigue.

Another stress test for striking tools is an overstrike test. During use, striking tools often miss their target resulting in "overstrike" where the handle neck of the striking tool makes contact with an unintended surface. Poorly designed tools often weaken when overstruck. Subsequent use of a weakened striking tool can cause failure of the tool which may cause injury of the user or a bystander. Therefore, using an overstrike test can help determine the resiliency of a striking tool. In an overstrike test, the handle neck strikes a rounded steel bar.

EXAMPLES

Example 1

A one-piece, heat-treated, aluminum alloy hammer machined from aluminum 6061 and including a steel cap affixed with a bushing was submitted to a strike test. The overall length of the hammer was about 16 inches, and it had a total weight of 21.3 oz. including the grip. The strike test consisted of placing the hammer in a machine that gripped the hammer by the grip and applied a torque of about 60 inch-lbs at the tool head to strike a surface. The hammer was struck against a surface having a hardness of about HRC 40. In this test, the striking surface of the hammer was struck against the surface over 250,000 times and was removed with the head and handle showing no signs of damage or fatigue. These results were unexpected in light of the number of blows and force applied to the aluminum alloy hammer.

Example 2

The prototype from Example 1 was submitted to an overstrike test as described above and similar to the test in Example 1 with the exception that the handle region directly below the head was struck against a round steel bar. The torque applied to accelerate the hammer into the rounded bar was approximately 60 inch-lbs at the tool head. The prototype was subjected to over 25,000 cycles and then removed from the machine. There were no signs of failure or fatigue of the tool. Slight visible damage was apparent where the aluminum had compressed and "mushroomed" at the point of contact between the tool and the bar. That the hammer could withstand this number of blows against the handle neck with little evident damage or fatigue was unexpected.

INDUSTRIAL APPLICABILITY

The striking tools described herein are constructed as aluminum alloy striking tools with one or more striking surfaces or accessories attached thereto. Such striking tools combine the advantage of being able to be light weight while providing a striking surface of sufficient hardness and durability.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved. All patents and publications are incorporated by reference. All values and ratios disclosed herein may vary by ±10%, ±20%, or ±40%.

We claim:

1. A striking tool, comprising:

a handle with a first end and a second end;

an aluminum head disposed on the second end, the aluminum head comprising an aluminum post, the post having an end face; and a steel cap having a first side and a second side opposite the first side, the first side comprising a striking surface, the second side having an annular surface about an opening of a cavity, wherein a portion of the cavity is defined by a mounting surface, wherein a portion of the post is received in the cavity of the cap and in contact with the mounting surface to permanently affix the cap to the post via a friction fit, wherein a first void space is within the cavity between the end face of the post and the cap, and wherein a second void space is between the annular surface and the aluminum head, and wherein a side surface of the portion of the post is tapered at an angle of less than 10 degrees relative to a longitudinal axis of the post such that the portion of the post has a first circumference and a second circumference, the second circumference less than the first circumference and the second circumference closer to the end face than the first circumference.

2. The striking tool of claim 1, wherein the handle comprises a polymer, a plastic, a composite, wood, carbon fiber, graphite, fiberglass, foam, rubber, leather, titanium, aluminum, steel, a polymer and/or metal alloy and/or superalloy suitable for additive manufacturing, or combinations thereof.

3. The striking tool of claim 1, wherein the portion of the post is tapered at an angle of less than 3 degrees along the side relative to the longitudinal axis of the post.

4. The striking tool of claim 3, wherein the portion of the post is in direct contact with the cap.

5. The striking tool of claim 1, wherein the post includes a cutout hollow portion.

6. The striking tool of claim 1, further comprising a steel claw attached to the aluminum head.

7. The striking tool of claim 1, wherein the portion of the post is tapered at an angle of less than 7 degrees along the side relative to the longitudinal axis of the post.

8. A hammer, comprising:

an aluminum head comprising a post, the post having a tapered portion and a first end face, the tapered portion of the post having a circular cross sectional shape; and a steel cap including an end wall and a sidewall extending from the end wall, the end wall and the sidewall defining a cavity, wherein the tapered portion is received in the cavity such that the sidewall is permanently affixed to the tapered portion via a friction fit without a bushing, and a first void space exists between the end wall and the first end face, and a second void space exists between a second end face of the sidewall and the aluminum head, wherein the tapered portion has a first circumference and a second circumference less than the first circumference, the second circumference being closer to the first end face of the post than the first circumference.

9. The hammer of claim 8, wherein the cap is permanently affixed to the head via only the friction fit.

10. The hammer of claim 8, wherein the portion of the post is tapered at an angle of less than 10 degrees along a side relative to a longitudinal axis of the post.

11. The hammer of claim 8, wherein the sidewall is in direct contact with the tapered portion.

12. The hammer of claim 8 further comprising an aluminum handle.

13. The hammer of claim 8, further comprising an accessory affixed to the head opposite the cap.

14. The hammer of claim 13, wherein the accessory is a claw.

15. The hammer of claim 8 wherein a portion of the sidewall is tapered.

16. The hammer of claim 8, wherein the hammer is adapted to withstand up to 50,000 blows of a striking surface of the cap against a surface having a hardness of HRC 40 delivered with a torque of 60 in-lbs at the head.

17. A striking tool, comprising:

a handle with a first end and a second end;

an aluminum head disposed on the second end and comprising a post having an end face and a hollow portion, the head integrally formed with the handle;

a cap having a first end and a second end opposite the first end, the first end including a striking surface, the cap surrounding a portion of the post and secured to the post via a friction fit, wherein a first void space is formed between the end face of the post and the cap, and a second void space is formed between the second end of the cap and the aluminum head; and a claw attached to the aluminum head and spaced apart from the cap, the claw being a material different than the aluminum head, wherein the striking tool is adapted to withstand up to 50,000 blows of the striking surface against a surface having a hardness of HRC 40 delivered with a torque of 60 in-lbs at the head.

18. The striking tool of claim 17, wherein each of the portion of the post and a mounting surface of the cap is tapered at an angle of greater than 0 degrees and less than 7 degrees relative to a longitudinal axis of the post.

19. The striking tool of claim 17, wherein the claw is steel.

20. The striking tool of claim 17, wherein the post includes a tapered portion, the tapered portion having a first circumference and a second circumference less than the first circumference, the second circumference being closer to the end face of the post than the first circumference.

* * * * *